United States Patent [19]

Nelson

[11] Patent Number: 4,830,415

[45] Date of Patent: May 16, 1989

[54] DOOR LATCHING MECHANISM FOR ROLL-UP DOORS

[76] Inventor: Stanford C. Nelson, 8 S. Merril Ave., Park Ridge, Ill. 60068

[21] Appl. No.: 55,017

[22] Filed: May 28, 1987

[51] Int. Cl.[4] ..... E05C 3/10

[52] U.S. Cl. ..... 292/134; 292/236; 292/DIG. 36; 292/DIG. 32

[58] Field of Search ..... 292/134, 130, 230, 236, 292/238, 231, 108, 210, DIG. 36, DIG. 63, DIG. 32; 105/310.1

[56] References Cited

U.S. PATENT DOCUMENTS

| | | | |
|---|---|---|---|
| 199,964 | 2/1878 | Davenport | 292/238 |
| 206,583 | 7/1878 | Lander | 292/236 |
| 657,742 | 9/1900 | Lewis | 292/108 |
| 818,547 | 4/1906 | McCord | 292/238 |
| 882,296 | 3/1908 | Carroll | 292/130 |
| 891,667 | 6/1908 | Browning | 292/238 |
| 1,157,854 | 10/1915 | Doering, Jr. | 292/238 |
| 1,177,495 | 3/1916 | Davis | 292/130 |
| 1,319,187 | 10/1919 | Summers | 292/238 |
| 1,434,325 | 10/1922 | Brown | 292/238 |
| 1,444,410 | 2/1923 | Witten | 292/238 |
| 1,446,078 | 2/1923 | Willis | 292/238 |
| 1,485,620 | 3/1924 | Larson | 292/236 |
| 1,489,965 | 4/1924 | Prentice | 292/108 |
| 1,495,373 | 5/1924 | Witten | 292/210 |
| 1,563,879 | 12/1925 | Thompson | 292/238 |
| 1,622,742 | 3/1927 | Shipman | 292/238 |
| 1,720,042 | 7/1929 | Hankwitz | 292/238 |
| 1,822,424 | 9/1931 | Scott | 292/346 |
| 2,042,317 | 5/1936 | Kuebler | 292/238 |
| 2,523,845 | 9/1950 | Roseburrough | 292/108 |
| 2,599,511 | 6/1952 | Dean | 292/134 |
| 2,749,164 | 6/1956 | Kitzelman | 292/DIG. 46 |
| 3,201,830 | 8/1965 | Senter | 105/378 |
| 3,958,822 | 5/1976 | Germer | 292/DIG. 36 |
| 4,598,941 | 7/1986 | Nelson | 292/134 |
| 4,647,088 | 3/1987 | Nelson | 292/136 |

FOREIGN PATENT DOCUMENTS

| | | | |
|---|---|---|---|
| 84087 | 6/1954 | Norway | 292/136 |
| 16511 | of 1893 | United Kingdom | 292/236 |

*Primary Examiner*—Gary L. Smith
*Assistant Examiner*—Erick Nicholson
*Attorney, Agent, or Firm*—Hill, Van Santen, Steadman & Simpson

[57] ABSTRACT

Locking latch device for use with roll-up doors on trucks and tractor-trailer vehicles which will automatically latch when closing the door and which can only be opened after a pendulous latch member is set to an unlatching position by the use of a release member. A locking device is provided to render the latching mechanism inoperable to prevent unauthorized opening of the roll-up door.

11 Claims, 3 Drawing Sheets

DOOR LATCHING MECHANISM FOR ROLL-UP DOORS

BACKGROUND OF THE INVENTION

The present invention relates to improvements in a door latch and more particularly to an improved locking latch mechanism for positively securing roll-up doors such as used on trailer-tractor vehicles or the like so that the door is automatically latched with its closing and can only be opened by activating an unobvious release member.

Trailor-tractor roll-up doors are commonly latched in a closed position, by manually operated locking mechanism which are readily accessible from the ground. For security to prevent unauthorized opening, the release handle is manually pivoted to a latching position after the door is closed and most often secured with a padlock. In the absence of the driver, the padlock or exposed locking mechanism can be broken, the door opened and the contents tampered with or stolen: Security of the roll-up door is imparative to protect valuable contents of a truck or trailer. As an example of the lack of security offered by conventional padlocking, insurance companies have found that a padlocked roll-up door can be broken and the contents stolen within a very short time, even while a truck is waiting for a traffic light.

While the features of the invention, as will be described herein, are particularly well suited for use on trucks or tractor-trailer type vehicles, it will be appreciated by those skilled in the art that the features of this invention may be employed for securely locking various other roll-up doors as well.

SUMMARY AND OBJECTS OF THE INVENTION

A feature of the present invention is the provision of a secure door latch for roll-up doors which will automatically latch when closing the door and can only be opened thereafter by a simple cocking or release setting operation. Herein, a latch member is set in an unlatching position with the aid of a cooperating release or trigger member and the latch is maintained in this unlatching position until the roll-up door is elevated. Thereupon, the latch member is disengaged from the release member to assume a latchable position. When the door is again lowered to a closed position, the latch will automatically latch to hold down the door by engagement with a keeper, carried on the trailer doorway post. Preferably, an enclosed cylinder lock is employed to prevent unauthorized persons from opening the roll-up door once it is latched.

An object of the present invention is to provide a locking latch device arranged to secure roll-up doors on trucks or tractor-trailer vehicles which will automatically latch when closing the door.

A further object of the invention is to provide a particularly simple and secure locking latch mechanism for roll-up doors wherein the latch member is set to a self-acting position by a release member which will permit the roll-up door to be raised to an open position and provides automatic relatching when the door is lowered to its closed position.

Other objects, features and advantages of the invention will be readily apparent from the following description of a preferred embodiment thereof, taken in conjunction with the accompanying drawings, although variations and modifications may be effected without departing from the spirit and scope of the novel concepts of the following disclosure.

DESCRIPTION OF THE PREFERRED EMBODIMENT

Figure 1:
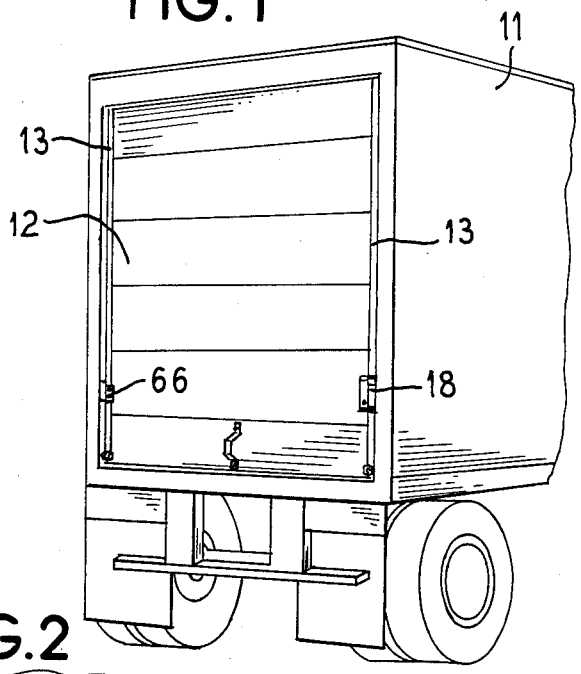
FIG. 1 is a fragmentary perspective view of the rear of a truck equipped with a roll-up door and showing the locking latch device of the present invention.
Figure 3:
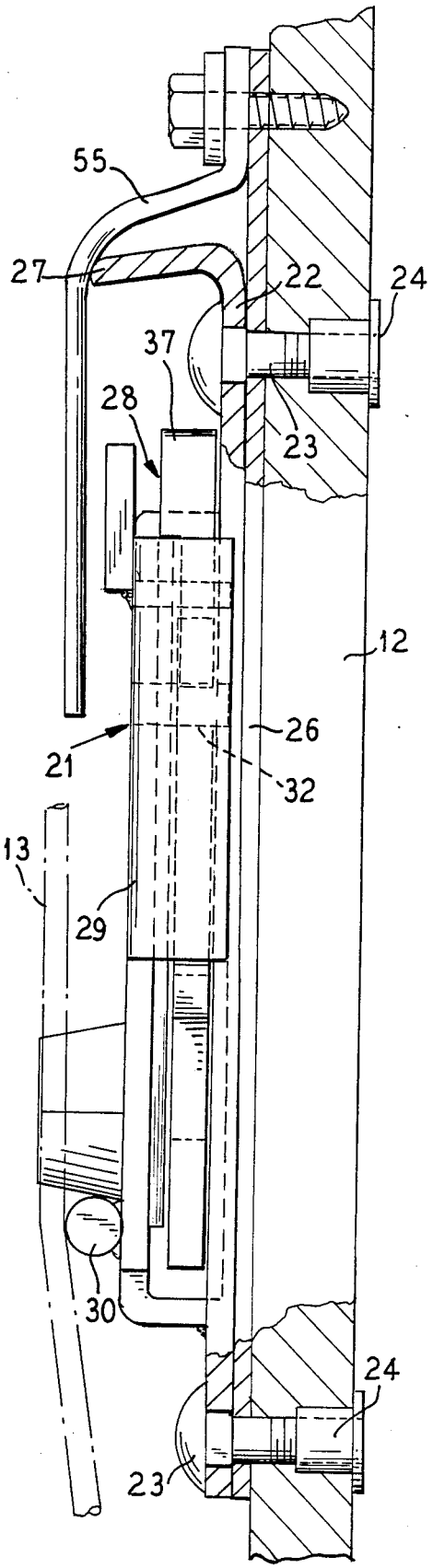
FIG. 3 is an enlarged vertical sectional view taken along line III—III of FIG. 2.
Figure 2:
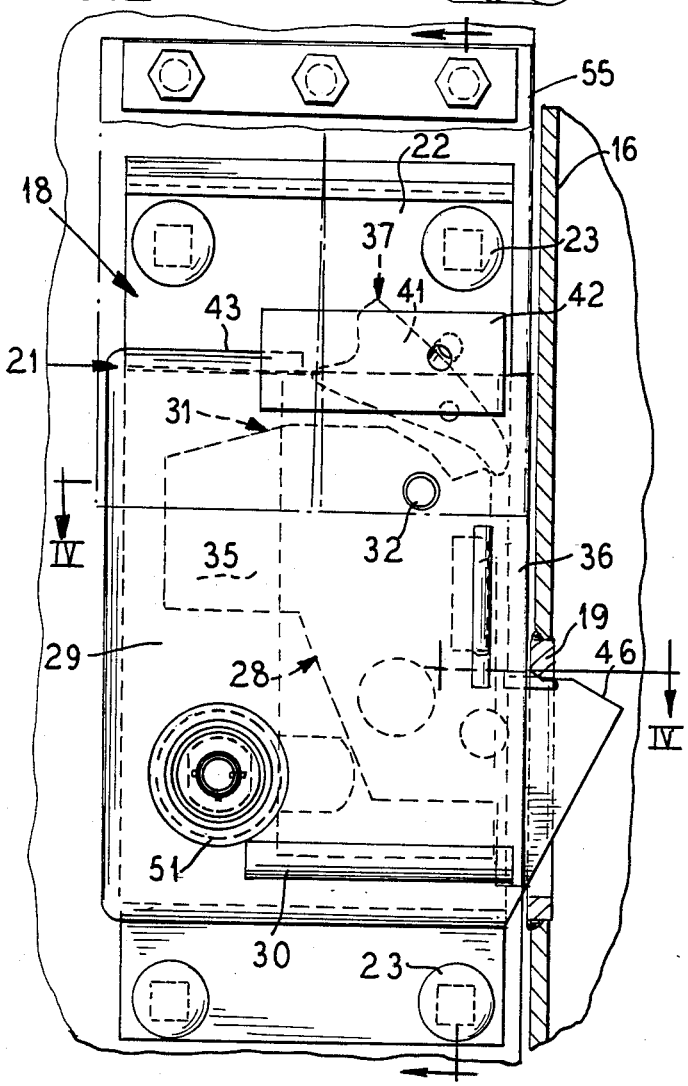
FIG. 2 is an enlarged view of the locking latch device showing the latch member in a latched and locked condition.

The embodiment of the invention illustrated in FIG. 1 of the drawings shows a lading carrying vehicle such as a truck 11 or the like provided with a conventional roll-up door 12. The door is equipped with the usual cable tensioned lift arrangement 13 to counter balance the weight of the door to facilitate lifting the door. The door is elevated along vertical tracks 14 on rollers 15 in a conventional roll-up door arrangement (See FIGS. 4 and 9). The tracks are secured to the inside of spaced vertical door posts 16, 17 which define the doorway of the vehicle. The door is further provided with a locking latch device 18 constructed in accordance with the principles of the present invention. A keeper 19 is mounted in the door post 16 by welding or other suitable means to cooperate with the latching device 18 to secure the roll-up door 12 in a closed condition. As best seen in FIGS. 2 and 3, the device 18 includes a housing 21 having an elongated back plate 22 bolted to a section of the roll-up door 12 as with carriage bolts 23 and "t" nuts 24. The shim 26 is provided between the back plate 22 and the door section to facilitate mounting. The back plate 22 is shown with an outward bent top portion 27 to extend over the latch device to protect the latching mechanism 28. The housing 21 also includes a formed cover plate 29 which is secured to the back plate 22 to enclose the latching mechanism 28. The cover plate is also shown provided with a cable guide 30 for the cable lift arrangement 13.

Figure 4:
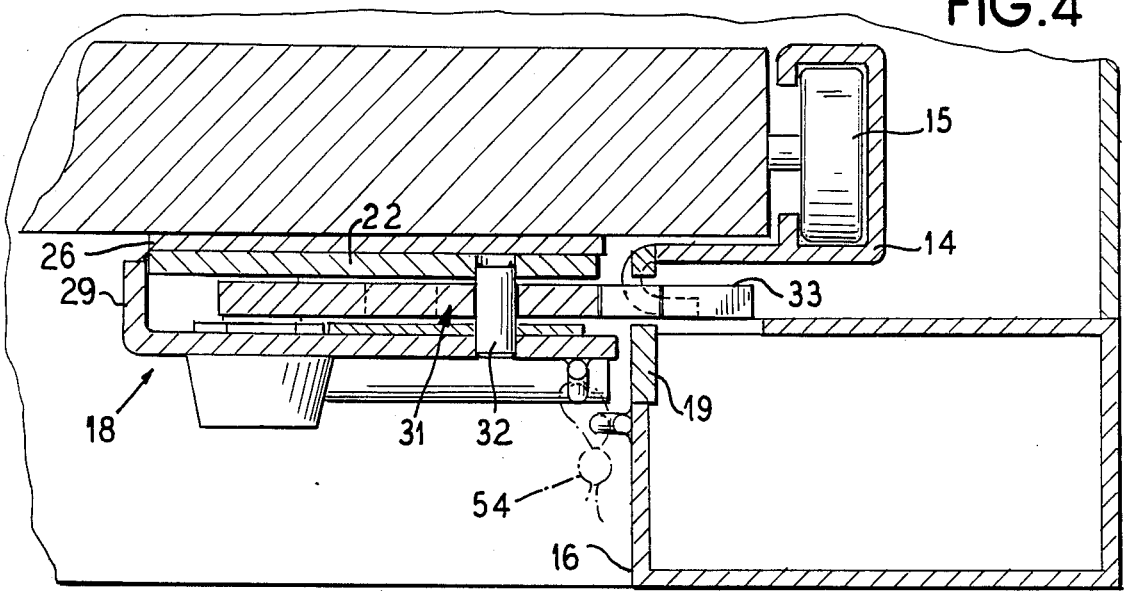
FIG. 4 is a transverse sectional view taken generally along the line IV—IV of FIG. 2.
Figure 5:
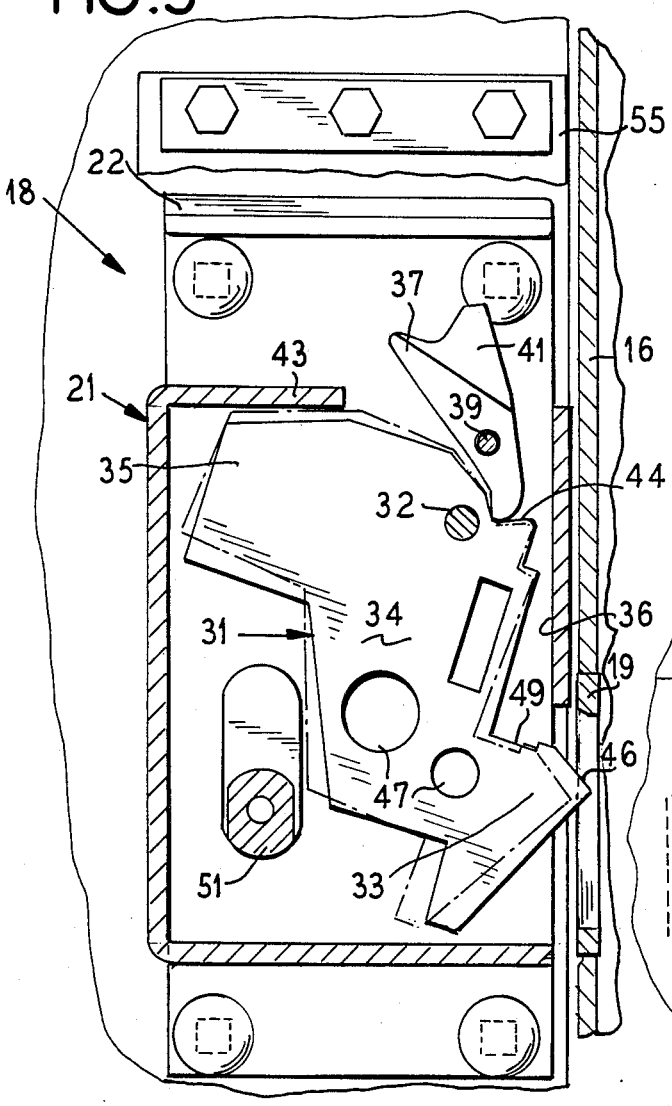
FIG. 5 is a vertical sectional view showing the latch member cocked in an unlatching position to pass over the keeper when the roll-up door is moved toward its open position.
Figure 6:
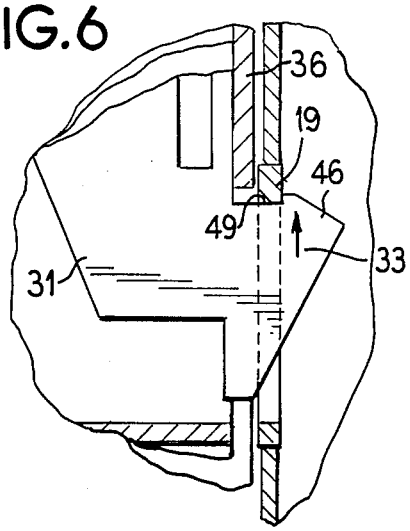
FIG. 6 is a fragmentary sectional view showing the latch in latching engagement with the keeper.

In FIG. 4, I have shown a horizontal sectional view taken through the locking latch device 18 having a latch member 31 transversely pivoted between the back plate 22 and the cover plate 29 of the housing 21 on a transverse pivot pin 32. As best seen in FIG. 5, the latch member 31 includes a latching head 33 extending horizontally from a lower end of a vertically disposed pendulous portion 34 and a counterweight portion 35 extending horizontally from an upper end of the pendulous portion and on a side opposite the latching head 33. The counterweight 35 is effective to provide a biasing force to urge the latch member 31 to the position shown in FIG. 2. Herein, the latch member is in abutment with wall 36 of the cover plate 29 whereby the latching head 33 engages the keeper 19 to prevent the roll-up door from opening. An opening in the wall 36 of the cover plate provides access to the keeper 19 by the latch head 33.

As best seen in FIGS. 2 and 5, the latch member 31 is virtually completely enclosed within the housing 21 and is only operable from outside the housing by the use of a release member 37 which must be activated to set the latch member to its unlatching position. The release member is pivoted between the back plate 22 and the cover plate 29 on a pivot pin 39 spaced above and slightly to the right of pivot pin 32 as seen in FIG. 5. A counterweight 41 is formed as an upper portion of the release member 37 and extends behind a guard plate 42 which is secured to the front of the cover plate 29. The release member 37 extends through an opening in a top wall 43 of the cover plate to provide access for manual operation. As shown in FIG. 2, the release member 37 is virtually hidden from view but may be readily operated by the thumb or fingers of the truck driver. The counterweight 41 is arranged to bias the release member to the released position shown in FIG. 2.

When it is desired to raise the roll-up door 12, the release member 37 is activated to cock or set the latch member 31 to its unlatching position shown in FIG. 5. Herein, to release the latching head 33 from the keeper 19, a lower end of the release member is moved in a clockwise direction to engage a stepped portion 44 to cam the latch to a release position. At this setting, an inclined surface 46 of the latching head 33 is effectively located so as to strike a complementary surface of the keeper when the door is raised. In contacting the keeper, the latch 31 is cammed backward to the broken line unlatched position, whereupon the counterweight 41 of the release member 37 causes disengagement with the latch member to drop down to the position shown in FIG. 2. The latching head 33 rides upward against the door post as the door is raised under the influence of its counterweight 41. The latch member is now again in a latching position and will automatically latch when the door is closed.

As shown in the drawings, the lower end of the vertically suspended pendulous portion 34 of the latch 31 has had metal removed as indicated by the reference number 47 to provide a more desirable weight distribution. Herein, the counterweight 35 is rendered most effective to hold the latching head in a latching position relative to the keeper 19. Since the latch member 31 is supported in a pendulous manner and with the latching surface laterally offset from the pivot pin 32 a small camming angle is present which could tend to pivot the latch member toward an unlatching position when a lifting force is applied to the door. To for stall this possibility, a notch 49 is formed in the latching surface of the latching head which will engage an inner edge of the keeper to positively prevent raising the roll-up door without first sitting the latch member in its unlatching position by the use of the release member 37.

A key operated locking device 51 is preferably incorporated into the housing 21 to lock the latch member 31 in a latched position as shown in FIG. 2. Herein, a finger is rotated by the locking device to a position immediately behind the latch member so that it will be rendered inoperative. Obviously, in this condition, the release member is also inoperative.

Figure 7:
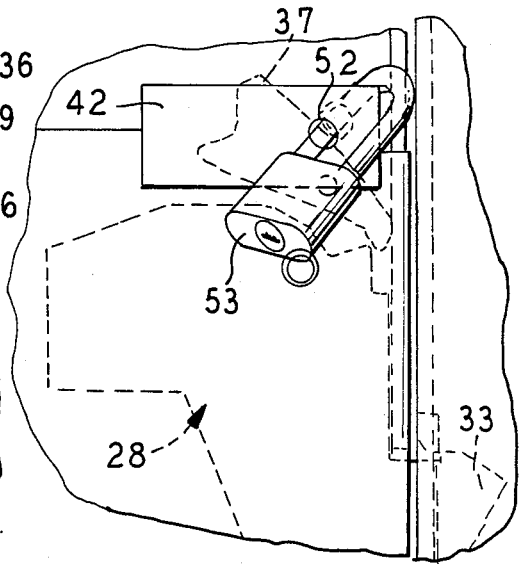
FIG. 7 is a fragmentary elevational view of an alternate locking arrangement for the device.

FIG. 7 shows an alternate locking arrangement in which the guard plate 42 is provided with an angled hole 52 through which a padlock 53 may be inserted to block the operational movement of the release member 37. Alternately, a cable seal may be used to lock the latching mechanism 28. Further, the use of a seal 54 may be desirable in some instances as a safeguard against tampering. As best seen in FIGS. 2 and 3, a weather guard 55 may be utilized to protect the latching mechanism 28.

Figure 8:
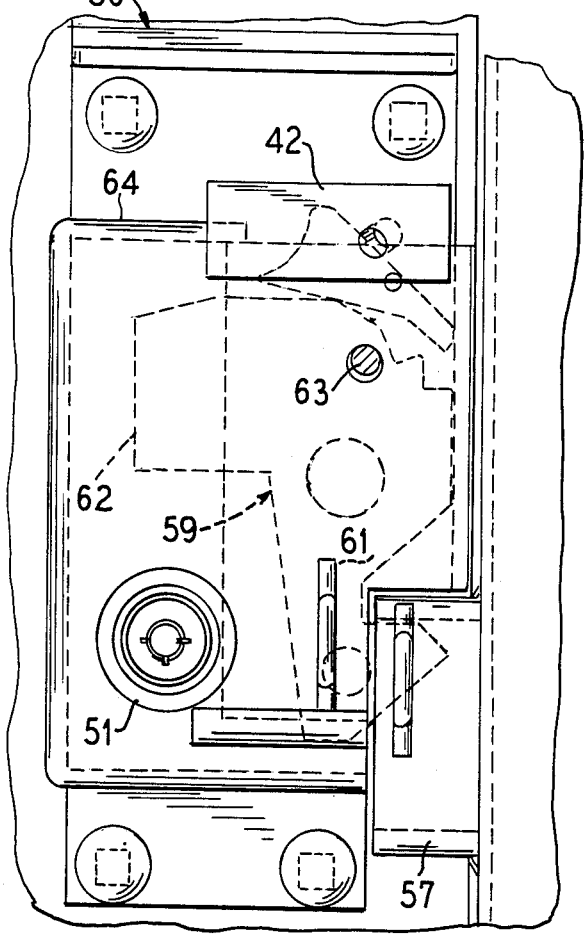
FIG. 8 is a view in side elevation view illustrating a modified form of the latch and keeper arrangement.
Figure 10:
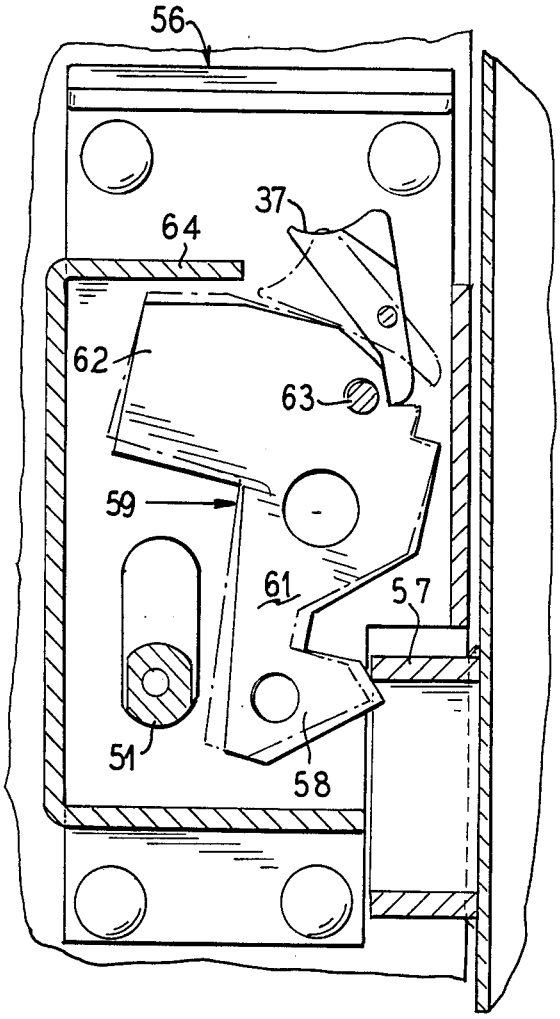
FIG. 10 is a vertical sectional view showing the latch member set in the unlatching position to pass over the keeper when the roll-up door is moved toward its open position.
Figure 9:
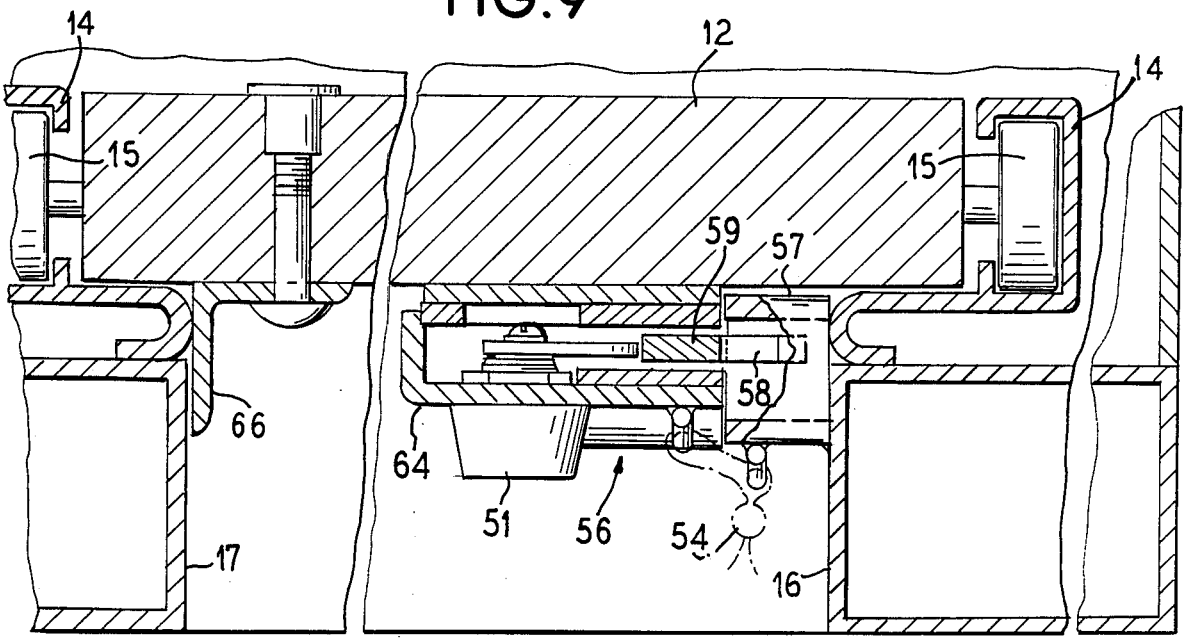
FIG. 9 is a fragmentary transverse sectional view taken through the rear of the truck roll-up door showing the locking latch device of FIG. 8.

In another embodiment of my invention, seen in FIGS. 8 to 10, a modified latch and keeper arrangement is provided in the locking latch device 56. Herein, the keeper comprises a rectangular tube section 57 secured to the door post 16 and extending therefrom to receive a latching head 58 of the latch member 59 similar to the latch member 31. Herein, the latching head 58 is formed as a recessed portion of the lower end of a vertical suspended pendulous portion 61 of the latch member 59, while a counterweight 62 extends from an upper end of the pendulous portion 61 to urge the latching head 58 into a counterclockwise direction as seen in FIG. 8, for engagement with the keeper 57. The latch member 59 is pivotably supported on a pivot pin 63 in the manner of the FIG. 2–5 embodiment. While the housing 64 has been somewhat modified to accommodate the keeper/-latch arrangement of this embodiment, the remaining elements of the locking latch device 56 are substantially identical in form and operation with the elements of the FIGS. 25 embodiment.

In FIG. 9, there are shown a sway guard 66 mounted on the roll-up door 12 for guiding movement along the door post 17 at the opposite side of the doorway from the locking latch device 56. Herein, the locking latch device is maintained at a minimal spacing with respect to the keeper 57 despite excessive clearances which may otherwise permit an undesirable sideways shifting of the door relative to the doorway opening. This same sway guard 66 is also provided on the FIGS. 2–5 embodiments as shown in FIG. 1.

I claim as my invention:

1. In combination with a lading carrying vehicle having a doorway therein defined by a pair of spaced door posts and having a roll-up door vertically movable between an open and closed position relative to the doorway, said roll-up door having a locking latch device for controllably securing and releasing the roll-up door comprising:

a housing means mounted to and movable with the roll-up door;

a keeper fixedly secured to one of the door posts;

a latch member enclosed in said housing and being alignable with said keeper when said roll-up door is in a closed position, said latching member including:

a pendulous portion vertically suspended in said housing on a pivot pin adjacent an upper end thereof;

a latching head portion carried on a lower end of said pendulous portion and arranged to engage said keeper; and a counterweight portion extending from the upper end of said pendulous portion and arranged to urge said latching head into engagement with said keeper when said roll-up door is closed;

a release member mounted in said housing on a pivot pin adjacent said latch member and having a counterweight thereon, wherein said release member is the sole means of camming said latch member to an unlatching position and being accessible only from a top portion of said housing means whereby said release member is pivoted to engage and hold said latch member in said unlatching position; and means to automatically release said latch member from said unlatching position including an angled surface carried on said latching head and arranged to contact said keeper to cam said latch member backward over said keeper upon movement of the roll-up door toward an open position and to concurrently disengage said latch member from said release member, whereupon said release member counterweight is effective to swing said release member free of said latch member, whereby said latch member will be repositioned to automatically engage said keeper upon closing the roll-up door.

2. The combination lading carrying vehicle and locking latch device of claim 1 in which the latch member is provided with a stepped portion for camming engagement with said release member to set the latch member in the unlatching position.

3. The combination lading carrying vehicle and locking latch device of claim 1, wherein said keeper is recessed into the door post and said latching head extends horizontally from said pendulous portion to engage said keeper when the door is in said closed position.

4. The combination lading carrying vehicle and locking latch device of claim 1, in which said keeper extends into the doorway from said door post and wherein said housing is recessed to accommodate the extending keeper and said latching head is recessively formed in the lower end of said pendulous portion of said latch member whereby said keeper receives said latching head when said roll-up door is in its closed position.

5. The combination lading carrying vehicle and locking latch device of claim 1, wherein a sway guard is mounted on the roll-up door to cooperate with said housing means to maintain the latching head of the latch member in a suitable lateral position relative to said keeper.

6. The combination lading carrying vehicle and locking latch device of claim 5, wherein a locking means is provided to render said latch member inoperative.

7. The combination lading carrying vehicle and locking latch device of claim 5, wherein a locking means is provided to render said release member inoperative.

8. The combination lading carrying vehicle and locking latch device of claim 5, wherein said housing includes a guard plate to protect and shield said release member.

9. The combination lading carrying vehicle and locking latch device of claim 5, in which said latching head includes a recessed latching surface arranged to engage said keeper to prevent a camming action release of the latching head relative to the keeper when a lifting force is applied to the roll-up door.

10. The combination lading carrying vehicle and locking latch device of claim 9 including means to rendered said counterweight portion of said latch member most effective including forming holes in said pendulous portion to provide a desirable weight distribution relative to said latch member.

11. A locking latch device for controllably securing and releasing a roll-up door relative to a door opening such as used on a truck or tractor-trailer vehicle comprising:

a housing means adapted to be mounted to and movable with the roll-up door;

a keeper adapted to be fixedly secured in said doorway;

a latch member enclosed in said housing and being alignable with said keeper when said roll-up door is in a closed position, said latch member comprising a pendulous portion vertically suspended on a pivot pin adjacent an upper end thereof and having a latching head carried on lower end of said pendulous portion that is arranged to engage said keeper, said latching head engaging an underside of said keeper to prevent opening of said roll-up door relative to said doorway unless released therefrom, said latch member further comprising a counterweight portion extending from an upper end of said pendulous portion and arranged to urge said latching head into latching engagement with said keeper with said roll-up door is closed;

a release member mounted in said housing on a pivot pin adjacent said latch member and having a counterweight thereon, said release member being the sole means of moving said latch member to an unlatching position, said release member camming on a surface of said latch member to set said latch member to its unlatching position; and means to automatically release said latch member from said unlatching position concurrently with opening of said roll-up door whereby said latch member will be repositioned to automatically engage said keeper upon closing of the roll-up door, said means including an angled surface carried on said latching head and arranged to contact said keeper to cam said latch member backward over said keeper upon movement of the roll-up door toward an open position and to concurrently disengage said latch member from said release member, said release member counterweight being effective to swing said release member free of said latch member when said release member and said latch member are disengaged, said latch member being repositioned to automatically engage said keeper upon closing of the roll-up door.

* * * * *